US010374288B2

(12) United States Patent
Harris et al.

(10) Patent No.: US 10,374,288 B2
(45) Date of Patent: Aug. 6, 2019

(54) APPARATUS COMPRISING AN ANTENNA HAVING CONDUCTIVE ELEMENTS

(71) Applicant: Nokia Technologies Oy, Espoo (FI)

(72) Inventors: Nadine Harris, Cambridge (GB); Samiul Haque, Cambridge (GB)

(73) Assignee: Nokia Technologies Oy, Espoo (FI)

( * ) Notice: Subject to any disclaimer, the term of this patent is extended or adjusted under 35 U.S.C. 154(b) by 222 days.

(21) Appl. No.: 15/504,746

(22) PCT Filed: Aug. 18, 2014

(86) PCT No.: PCT/FI2014/050634

§ 371 (c)(1),
(2) Date: Feb. 17, 2017

(87) PCT Pub. No.: WO2016/026999

PCT Pub. Date: Feb. 25, 2016

(65) Prior Publication Data

US 2017/0271750 A1 Sep. 21, 2017

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/364* (2013.01); *H01Q 1/368* (2013.01); *H01Q 1/38* (2013.01);
(Continued)

(58) Field of Classification Search
CPC ..... H01G 5/30; H01G 1/364; H01G 1/368; H01G 1/38; H01G 3/01; H01G 9/14; H01G 9/145; H01G 9/16; H01G 9/20
See application file for complete search history.

(56) References Cited

U.S. PATENT DOCUMENTS

| | | | |
|---|---|---|---|
| 6,204,818 | B1 | 3/2001 | Chang et al. |
| 6,239,765 | B1 | 5/2001 | Johnson et al. |
| 7,339,542 | B2 | 3/2008 | Lalezari |
| 7,501,991 | B2 | 3/2009 | Yeap |
| 2006/0253942 | A1 | 11/2006 | Barrera et al. |
| 2012/0075069 | A1 | 3/2012 | Dickey et al. |

(Continued)

FOREIGN PATENT DOCUMENTS

| | | | |
|---|---|---|---|
| CN | 103647150 | A | 3/2014 |
| DE | 202006002143 | U1 | 5/2006 |

(Continued)

OTHER PUBLICATIONS

Office action received for corresponding Korean Patent Application No. 2017-7007304, dated Jan. 22, 2018, 4 pages of office action and no page of translation available.

(Continued)

*Primary Examiner* — Graham P Smith
(74) *Attorney, Agent, or Firm* — Alston & Bird LLP

(57) ABSTRACT

An apparatus (10) comprising a substrate (2) and an antenna (20). The antenna (20) comprising a first conductive element (21) having a first electrical length and connected to a first antenna terminal (31) and a second conductive element (22) having a second electrical length connected to a second antenna terminal (32), wherein at least the first conductive element is supported by a first portion of the substrate (11) and wherein at least the first portion of the substrate is configured to deform from a first configuration to a second configuration to: change the first electrical length of the first conductive element relative to the second electrical length of the second conductive element; and add or remove at least one operational resonant mode of the antenna.

20 Claims, 3 Drawing Sheets

(51) Int. Cl.

| | |
|---|---|
| ***H01Q 9/14*** | (2006.01) |
| ***H01Q 9/20*** | (2006.01) |
| ***H01Q 1/36*** | (2006.01) |
| ***H01Q 3/01*** | (2006.01) |
| ***H01Q 9/16*** | (2006.01) |
| ***H01Q 5/30*** | (2015.01) |

(52) U.S. Cl.

CPC ..... *H01Q 3/01* (2013.01); *H01Q 5/30* (2015.01); *H01Q 9/14* (2013.01); *H01Q 9/145* (2013.01); *H01Q 9/16* (2013.01); *H01Q 9/20* (2013.01)

(56) References Cited

U.S. PATENT DOCUMENTS

| | | | |
|---|---|---|---|
| 2012/0154248 | A1 | 6/2012 | Haque et al. |
| 2012/0176289 | A1 | 7/2012 | Lee |
| 2013/0004658 | A1 | 1/2013 | Yang |

FOREIGN PATENT DOCUMENTS

| | | | |
|---|---|---|---|
| GB | 2383470 | A | 6/2003 |
| KR | 2013-0033211 | A | 4/2013 |
| WO | 2008/004041 | A1 | 1/2008 |
| WO | 2011/060825 | A1 | 5/2011 |
| WO | 2012066452 | A1 | 5/2012 |

OTHER PUBLICATIONS

International Search Report and Written Opinion received for corresponding Patent Cooperation Treaty Application No. PCT/FI2014/050634 dated Aug. 18, 2014, 15 pages.

Mazlouman, S. J., et al., "A reconfigurable patch antenna using liquid metal embedded in a silicone substrate", IEEE: Transactions on Antennas and Propagation, vol. 59, No. 12, Dec. 2011, pp. 4406-4412. abstract.

Liyakath, R. A., et al., "Multilayer stretchable conductors on polymer substrates for conformal and reconfigurable antennas", IEEE Antennas and Wireless Propagation Letters, vol. 12, May 2013, pp. 603-606. abstract.

Mazlouman, S. J., et al., "A review of mechanically reconfigurable antenna using smart material actuators", Proceedings of the 5th European Conference on Antennas and Propagation, Apr. 11-15, 2011, Rome, Italy, pp. 1076-1079.abstract.

Extended European Search Report received for corresponding European Patent Application No. 14900300.6, dated Mar. 19, 2018, 8 pages.

Liyakath, "Reconfigurable Antenna and RF Circuits Using Multi-Layer Stretchable Conductors", Thesis, Jun. 28, 2012, 120 Pages.

Kubo et al., "Stretchable Microfluidic Radiofrequency Antennas", Advanced Materials, vol. 22, No. 25, 2010, pp. 2749-2752.

Dickey et al., "A Microfabricated Stretchable Antenna for Wireless Strain Sensing", AICHE Annual Meeting, 2010.

Song et al., "Stretchable and Reversibly Deformable Radio Frequency Antennas Based on Silver Nanowires", ACS Applied Mater Interfaces, vol. 6, 2014, pp. 4248-4253.

Huang et al., "Graphene Pattern by Gravure Printing for Wireless Strain Sensor", Seventh International Conference on Sensing Technology, 2013, pp. 387-389.

Yin et al., "A Carbon Nanotube/polymer Strain Sensor with Linear and Antisymmetric Piezoresistivity", Journal of Composite Materials, vol. 45, No. 12, 2011, pp. 1315.1323.

"Stretchable Antenna for Wearable Health Monitoring", ScienceDaily, Retrieved on May 17, 2017, Webpage available at : https://www.sciencedaily.com/releases/2014/03/140318093719.htm.

Myers, A., *Stretchable Antenna for Wearable Health Monitoring* [online] [retrieved Feb. 19, 2019]. Retrieved from the Internet: https://www.sciencedaily.com/releases/2014/03/140318093719.htm>. (dated Mar. 18, 2014) 5 pages.

APPARATUS COMPRISING AN ANTENNA HAVING CONDUCTIVE ELEMENTS

RELATED APPLICATION

This application was originally filed as Patent Cooperation Treaty Application No. PCT/FI2014/050634 filed Aug. 18, 2014.

TECHNOLOGICAL FIELD

Embodiments of the present invention relate to an apparatus comprising an antenna having conductive elements.

BACKGROUND

An antenna is configured to selectively transmit/receive electromagnetic radiation at certain ranges of frequencies (bandwidths). If the antenna is sufficiently efficient at transmitting/receiving electromagnetic radiation at a particular bandwidth then that bandwidth is an operational bandwidth which may be used for telecommunication. An operational bandwidth is therefore a frequency range over which an antenna can efficiently operate. Efficient operation occurs, for example, when the antenna's return loss S11 is greater than an operational threshold such as 3 or 4 dB (these are expressed as a positive quantity because they are a loss).

A dipole antenna, for example as illustrated in FIG. 1A to FIG. 1D, typically comprises first and second conductive elements. The electrical lengths associated with the conductive elements results in certain frequencies of electromagnetic radiation becoming resonant. Typically, resonant modes may occur for standing waves at a multiple of half a wavelength ($n\lambda/2$) of the electromagnetic radiation. FIG. 1A illustrates a first resonant mode (first harmonic) $\lambda/2$, FIG. 1B illustrates a second resonant mode (second harmonic), FIG. 1C illustrates a third resonant mode (third harmonic) $3\lambda/2$ and FIG. 1D illustrates a fourth resonant mode (fourth harmonic) $2\lambda$. However, for a dipole antenna, even resonant modes (even harmonics) illustrated in FIGS. 1B and 1D are not operational and are suppressed because the input impedance at the antenna, at these frequencies, becomes large as the current at the feed becomes small.

FIG. 2 illustrates, in a plot of the return loss S11, the odd resonant modes of the dipole antenna, illustrated in FIGS. 1A to 1D. It will be appreciated that of all the resonant modes 51 of the dipole antenna, only the first resonant mode (first harmonic) and the third resonant mode (third harmonic) and similar odd resonant modes (odd harmonics) are operational. An operational resonant mode may, for example, be arbitrarily defined as one with an operational bandwidth. Using this definition, and referring to FIG. 2, it can be seen that there are no operational resonant modes corresponding to the even harmonics illustrated in FIGS. 1B and 1D.

BRIEF SUMMARY

According to various, but not necessarily all, embodiments of the invention there is provided an apparatus comprising:

a substrate;

an antenna comprising:

a first conductive element having a first electrical length and connected to a first antenna terminal; and a second conductive element having a second electrical length connected to a second antenna terminal, wherein at least the first conductive element is supported by a first portion of the substrate and wherein at least the first portion of the substrate is configured to deform from a first configuration to a second configuration to:

change the first electrical length of the first conductive element relative to the second electrical length of the second conductive element; and add or remove at least one operational resonant mode of the antenna.

According to various, but not necessarily all, embodiments of the invention there is provided an apparatus comprising: antenna means comprising first radiator means and second radiator means; and deformable support means for supporting at least a portion of the first radiator means; wherein deformation of the support means adds or removes at least one operational resonant bandwidth of the antenna means.

According to various, but not necessarily all, embodiments of the invention there is provided examples as claimed in the appended claims.

BRIEF DESCRIPTION

For a better understanding of various examples that are useful for understanding the brief description, reference will now be made by way of example only to the accompanying drawings in which.

DETAILED DESCRIPTION

In the following examples, actuation of an apparatus 10, for example by deforming a portion of the apparatus 10, results in the addition or removal of at least one operational resonant mode (operational bandwidth) of an antenna 20. The addition or removal of such an operational resonant mode (operational bandwidth) of the antenna 20 may be detected and, in some examples, may be used as a trigger to indicate or measure the actuation of the apparatus 10. Thus the apparatus 10 may be used as a sensor.

Figure 1A:
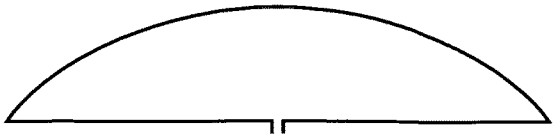
FIGS. 1A to 1D illustrate resonant (odd and even) harmonic modes of a dipole antenna.
Figure 1B:
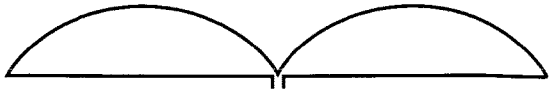
Figure 1C:
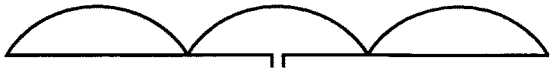
Figure 1D:
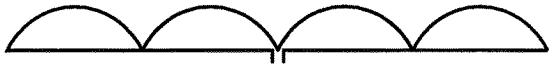
Figure 2:
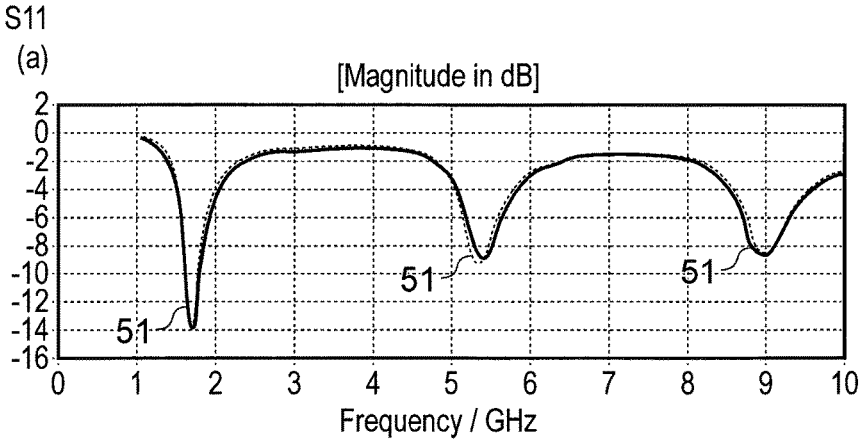
FIG. 2 illustrates the return loss S11 for odd resonant harmonic modes of a dipole antenna.
Figure 3:
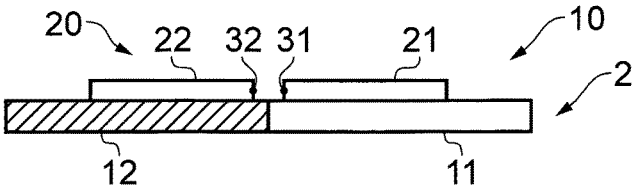
FIG. 3 illustrates an example of an apparatus comprising an antenna where deformation of the apparatus results in the addition or removal of at least one operational resonant mode (operational bandwidth) of the antenna.

FIG. 3 illustrates an example of an apparatus 10 comprising an antenna 20. Deformation of the apparatus 10 results in the addition or removal of at least one operational resonant mode (operational bandwidth) of the antenna 20.

Figure 4:
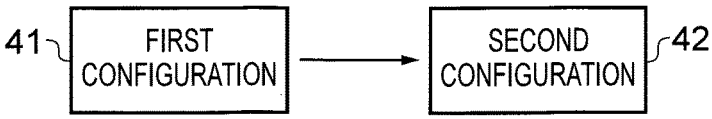
FIG. 4 illustrates a first configuration and a second configuration.

The apparatus 10 comprises a substrate 2 and an antenna 20. The antenna 20 comprises a first conductive element 21 and a second conductive element 22. At least the first conductive element 21 is supported by a first portion 11 of the substrate 2. This first portion 11 of the substrate 2 is configured to deform from a first configuration 41 to a second configuration 42, as illustrated in FIG. 4.

The first conductive element 21 is connected to a first antenna terminal 31 and the second conductive element 22 is connected to a second antenna terminal 32. In some examples these antenna terminals 31, 32 may be interconnected.

The first conductive element 21 has a first electrical length $E_1$ and the second conductive element has a second electrical length $E_2$.

The antenna 20 may be a dipole antenna or another member of a set of multi-terminal antennas. A multi-terminal antenna, which may also be called a multi-feed antenna comprises at least a first conductive element 21 connected to a first antenna terminal 31 and a second conductive element 22 is connected to a second antenna terminal 32. In some but not necessarily all example, it may comprise additional conductive elements and respective antenna terminals.

A dual-terminal antenna, which may also be called a dual-feed antenna comprises a first conductive element 21 connected to a first antenna terminal 31 and a second conductive element 22 is connected to a second antenna terminal 32.

A multi-terminal antenna 20 may be operated as an unbalanced antenna, where one terminal (feed) is coupled to radio frequency circuitry and another terminal (feed) is coupled to ground.

A dual terminal antenna 20 may be operated as a balanced antenna, where all terminals (feeds) are coupled to radio frequency circuitry.

Examples of multi-terminal antennas include, but are not limited to: a Yagi Uda array, two arm planar log spiral antenna, X-poles antennas such as dipole antennas, tripole antennas etc.

The shape of the conductive elements may be any suitable shape.

In the following examples, reference will be made to a dipole antenna 20, however, it should be appreciated from the foregoing that different antennas 20 may, in other examples, be used such as: multi-terminal antennas (e.g. multi-feed antennas), dual-terminal antennas (e.g. dual-feed antennas), balanced antennas, unbalanced antennas, X-pole antennas including dipole antennas and tripole antennas, Yagi Uda array, two arm planar log spiral antenna.

FIG. 4 illustrates a first configuration 41 of the apparatus 10 and a second configuration 42 of the apparatus 10. In the first configuration 41, the substrate 2 has a first configuration and in the second configuration 42, the substrate 2 has a second configuration.

The change in configuration from the first configuration 41 to the second configuration 42 results in a change in the first electrical length $E_1$ of the first conductive element 21 relative to the second electrical length $E_2$ of the second conductive element 22 and results in the addition or removal of at least one operational resonant mode (operational bandwidth) of the antenna 20.

Figure 6A:
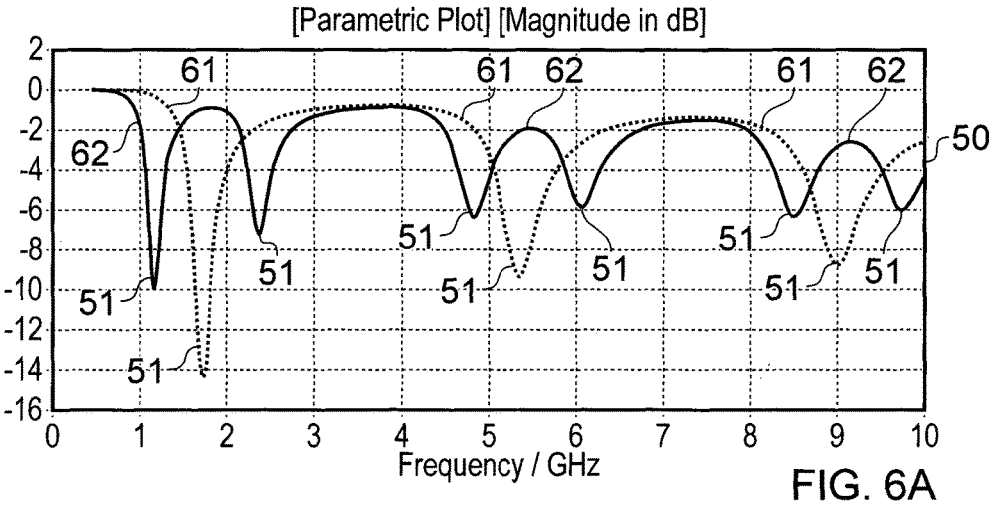
FIGS. 6A and 6B illustrate addition/removal of an operational resonant mode (operational bandwidth) of an antenna by plotting, respectively, return loss S11 and impedance.
Figure 6B:
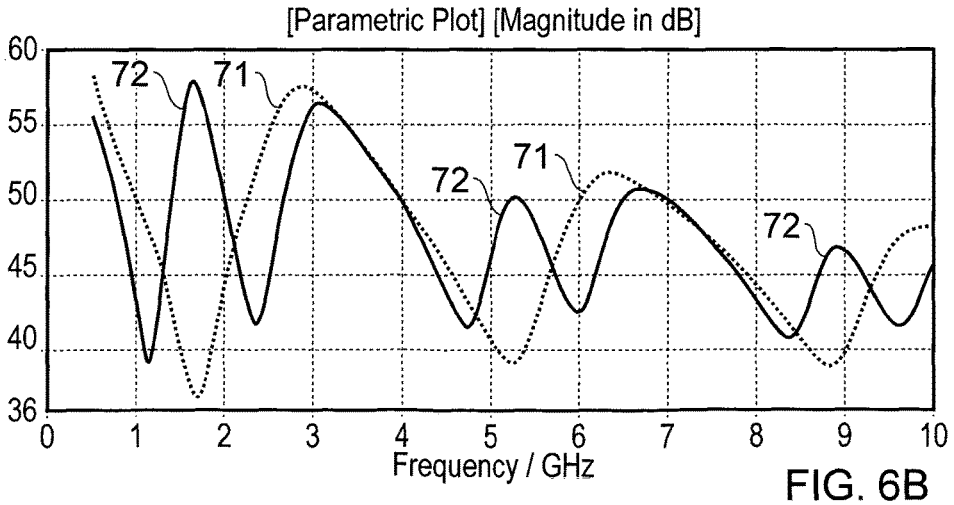

FIGS. 6A and 6B illustrate in more detail the addition/removal of operational resonant modes (operational bandwidths) of an antenna.

FIG. 6A illustrates the return loss S11 of an antenna 20. The figure comprises a first return loss response 61 for the first configuration 41 and a second return loss response 62 for the second configuration 42. The first return loss response 61 for the first configuration 41 comprises three minima, each of which is associated with a resonant mode (bandwidth) of the antenna 20. The second return loss response 62 of the second configuration 42 has six minima, each of which is associated with a resonant mode (bandwidth) 51 of the antenna 20 when it is in the second configuration 41. It can be observed from FIG. 6A, that the change in configuration from the first configuration 41 to the second configuration 42 results in a redistribution of absorbed/radiated energy over different bandwidths 51 some of which are operational. For example, the highly efficient resonant modes 51 in the first configuration 41 are each split into two less efficient resonant modes 51 of the second configuration 42. The change in configuration splits the absorbed/radiated energy across more distinct bandwidths 51.

An operational resonant mode (operational bandwidth) is a frequency range over which an antenna can efficiently operate. An operational resonant mode (operational bandwidth) may be defined as where the return loss S11 of the dipole antenna 20 is greater than an operational threshold T such as, for example, 3 or 4 dB and where the radiated efficiency ($e_r$) is greater than an operational threshold such as for example—3 dB in a radiation efficiency plot. Radiation efficiency is the ratio of the power delivered to the radiation resistance of the antenna ($R_{rad}$) to the total power delivered to the antenna: $e_r=(R_{rad})/(R_L+R_{rad})$, where $R_L$=loss resistance (which covers dissipative losses in the antenna itself). It should be understood that "radiation efficiency" does not include power lost due to poor VSWR (mismatch losses in the matching network which is not part of the antenna as such, but an additional circuit). The "total radiation efficiency" comprises the "radiation efficiency" and power lost due to poor VSWR [in dB]. The radiation efficiency operational threshold could alternatively be expressed in relation to "total radiation efficiency" rather than "radiation efficiency".

In the example of FIG. 6A, if we take the operational threshold of the return loss S11 to be 4 dB, then at least the operational first resonant mode (bandwidth) of the first configuration 41 disappears and is replaced by two distinct and non-overlapping operational resonant modes (bandwidths) of the second configuration 42.

In this example, when switching from the first configuration 41 to the second configuration 42, additional operational bandwidths are created. The corollary of this is that on switching from the second configuration 42 to the first configuration 41, operational bandwidths disappear.

The addition or removal of at least one operational resonant mode of the antenna 20 may occur by changing the first electrical length $E_1$ and/or the second electrical length $E_2$ when the configuration of the antenna 20 is changed from the first configuration 41 to the second configuration 42 and when the second configuration 42 is changed to the first configuration 41.

For example, one of the first configuration 41 and the second configuration 42 may provide a symmetric antenna 20 where the first and second electrical lengths $E_1$, $E_2$ are equal and the other of the first configuration 41 and the second configuration 42 provides an asymmetric antenna 20 where the first and second electrical lengths $E_1$, $E_2$ are unequal.

Referring back to FIG. 6A, in this example the first configuration 41 may provide a symmetric antenna 20 where the first and second electrical lengths $E_1$, $E_2$ are equal and the second configuration 42 may provide an asymmetric antenna 20 where the first and second electrical lengths $E_1$, $E_2$ are unequal.

The substrate 2, and in particular the first substrate portion 11, may be configured for asymmetric deformation. The asymmetric deformation of the substrate 2 results in a changing configuration. The asymmetric deformation of the substrate, in addition, results in a change in the first electrical length $E_1$ and/or the second electrical length $E_2$. For example, if the first substrate portion 11 is deformed and changes the first electrical length $E_1$, while the second substrate portion 12 is not deformed or is less deformed and the second electrical length $E_2$ remains the same or changes less, then an asymmetry in electrical length is created between the conductive elements 21, 22 of the antenna 20.

In some but not necessarily all examples, when the apparatus 10 is in the first configuration 41, the first electrical length $E_1$ equals the second electrical length $E_2$ and when the first portion 11 of the substrate 2 is in the second configuration 42 the first electrical length $E_1$ does not equal the second electrical length $E_2$.

In some, but not necessarily all, examples the first conductive element 21 may comprise a graphene-based material and/or the second conductive element 22 may comprise a graphene-based material.

A graphene-based material may, for example, comprise graphene, a graphene derivative, chemical vapor-deposited graphene or metal nanoparticle doped graphene, or other material including or derived from graphene. Other 2D materials such as $MOS_2$ or its derivative can be used for such application.

The first conductive element 21 may, in some but not necessarily all examples, be formed by, and not limited to, printing technologies such as screen printing, 3D printing, inkjet printing, and so on.

Graphene-based material may be particularly robust to repeated straining. It may have a lifetime of many compressions/extensions without failure. It may also be tuned to operate over very large bandwidths, for example, MHz-THz In this example, but necessarily all examples, the first conductive element 21 and the second conductive element 22 are formed from the same surface area of the conductive material. The first conductive element 21 and the second conductive element 22 may have the same cross-sectional area of conductive material.

The electrical length of a conductive element, for example the first conductive element 21, may change as a consequence of changing its physical length or changing the relative permittivity associated with the first conductive element 21. In some, but not necessarily all, examples a change in the electrical length may be achieved by a change in relative permittivity of the first substrate portion 11. In other examples a change in electrical length of the first conductive element 21 may be achieved, in addition or alternatively, by changing the physical length of the first conductive element 21.

Figure 5A:
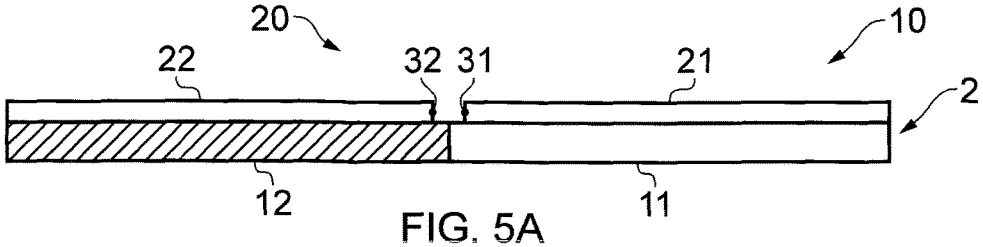
FIGS. 5A and 5B illustrate an example of the apparatus in a first configuration and in a second configuration.
Figure 5B:
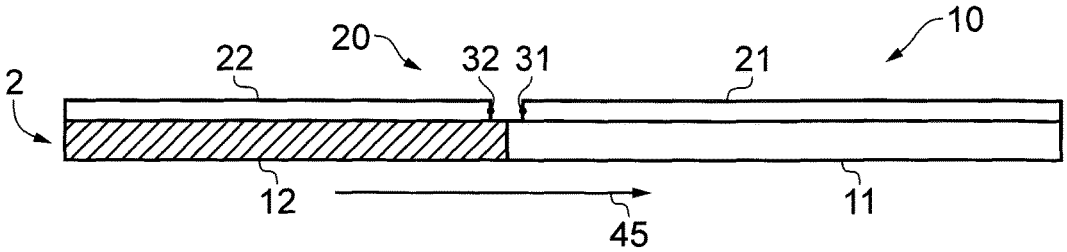

FIGS. 5A and 5B illustrate an example of an apparatus 10 where a change from the first configuration 41 to the second configuration 42 results in a change in the physical length of the first conductive element 21 of an antenna 20. In this example, but not necessarily all examples, the antenna 20 is a dipole antenna.

The apparatus 10, and, in particular, the first conductive element 21 is configured to be strained in use while the second conductive element 22 remains unstrained. For example, the second conductive element 22 may be supported on a second portion 12 of the substrate 2 different to the first portion 11 where a Young's modulus of the second portion 12 is significantly greater than a Young's modulus of the first portion 11. This will mean that the second portion 11 of the substrate 2 is significantly stiffer than the first substrate portion 11. For example, the first portion 11 may be resiliently deformable and formed from an elastomeric material whereas the second portion 12 may be rigid. Stretchable substrates or any type of deformable substrate can be used.

The stiffness of the first substrate portion 11 and/or the second portion 11 of the substrate 2 may be controlled. For example, the substrate could go under graded deformation which means parts of the substrate could be stiffened using different chemical functionalization (different cross linking). If the substrate is graded then it has a direct impact on the antenna deformation.

Substrates such as polydimethylsiloxane (PDMS), Polyurethane, polyethyletetraphalate (PET), polyethylenenapthalate (PEN), or other polymers such as poly (4,4'-oxydiphenylene-pyromellitimide).

In the example of FIG. 5A, the first conductive element 21 is an elongate element aligned along a first axis and the second conductive element 22 is an elongate element aligned along a second axis. The first and second axes are aligned along a strain axis 45 of the apparatus 10.

The first conductive element 21 has a first physical length $L_1$ and the second conductive element 22 has a second physical length $L_2$. The first portion 11 of the substrate 2 supporting the first conductive element 21 is configured to deform from a first configuration 41 to a second configuration 42 and this deformation changes the first physical length $L_1$.

The asymmetric nature of the substrate 2 results in asymmetric deformation of the first conductive element 21 and the second conductive element 22, which in turn results in an asymmetric change in the physical lengths of the first conductive element 21 and the second conductive element 22. This asymmetric change in physical length also results in an asymmetric change in electrical length and results in the addition/removal of operational resonant modes of the antenna 20.

In the example of FIGS. 5A and 5B, but not necessarily all examples, the deformation of the first portion 11 of the substrate 2 when changing from the first configuration 41 to the second configuration 42 results in the stretching of the first portion 11 of the substrate 2 and the stretching of the first conductive element 21. The stretching may, for example, arise from elongation along an axis or by bending.

In some, but not necessarily all, examples, in the first configuration 41 the first physical length $L_1$ is equal to the second physical length $L_2$ and in the second configuration 42 the first physical length $L_1$ does not equal the second physical length $L_2$. During the change in configuration, the second physical length $L_2$ may remain constant, while the first physical length $L_1$ changes.

FIG. 6B illustrates the impedance of the antenna 20 for the same frequency range as used for FIG. 6A. It can be seen that the minima in the return loss S11 have corresponding minima in the impedance. The figure comprises a first impedance 71 for the first configuration 41 and a second impedance 72 for the second configuration 42. The first impedance 71 for the first configuration 41 comprises three minima, each of which is associated with a resonant mode (bandwidth) of the antenna 20. The second impedance 72 of the second configuration 42 has six minima, each of which is associated with a resonant mode (bandwidth) of the antenna 20 when it is in the second configuration 42. It can be observed from FIG. 6B, that the change in configuration from the first configuration 41 to the second configuration 42 results in a change in the impedance characteristics of the antenna 20.

According to one model of the operation of the apparatus 10, it is possible to consider that resonant modes and their associated bandwidths exist at each harmonic $n\lambda/2$ of the antenna 20. However, the even harmonics (n even) have very high impedance (since the S11 response affects the radiated efficiency, a high impedance thereby causes degradation or significant reduction of the radiated efficiency of the antenna) such that none of the bandwidths/modes are operational and the odd harmonics (n odd) have a very low impedance ((since the S11 response affects the radiated efficiency, a low impedance thereby causes the antenna to radiate efficiently) such that at least some of the bandwidths/modes associated with the odd harmonics are operational.

According to this model, the change in configuration from the first configuration 41 to the second configuration 42, changes the efficiency of the resonant modes/bandwidths associated with the even harmonics. Thus bandwidths/modes that were suppressed in the first configuration 41 are no longer suppressed in the second configuration 42.

Figure 7:
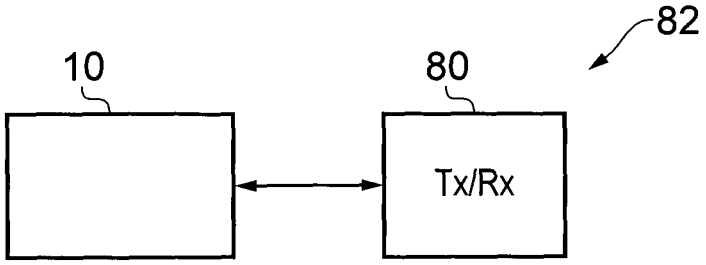
FIG. 7 illustrates an example of a system comprising the apparatus and circuitry configured to use the apparatus.

FIG. 7 illustrates an example of a system 82 comprising the apparatus 10 and circuitry 80 configured to transmit using the antenna 20 when the first conductive element 21 is in the first configuration 41 and also when the first conductive element 21 is in the second configuration 42. The circuitry 80 is thus able to use the antenna 20 for data transmission irrespective of the configuration.

Figure 8:
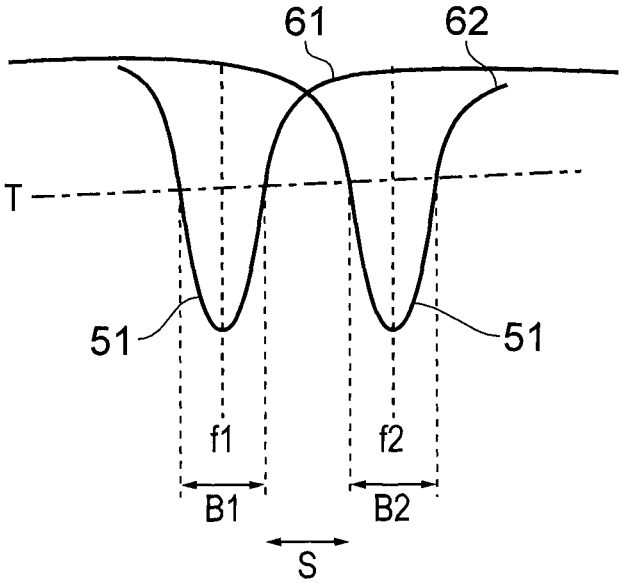
FIG. 8 illustrates a portion of FIG. 6A in more detail.

The circuitry 80 may be configured to transmit using the antenna 20 when the first conductive element is in the first configuration 41 using a first operational bandwidth 51 defined by a center frequency f1 and a bandwidth B1 (see FIG. 8). The circuitry 80 may additionally be configured to transmit using the antenna 20 when the first conductive element 21 is in the second configuration 42 using a second operational bandwidth 51 defined by a center frequency f2 and a bandwidth B2 (see FIG. 8).

In the example of FIG. 8, which illustrates a portion of FIG. 6A, the first operational bandwidth 51 and the second operational bandwidth 51 do not overlap. The separation S between the first operational bandwidth and the second operational bandwidth may be defined as $S=f2-f1-\frac{1}{2}(B1+B2)>0$. The circuitry 80 has a data communication mode for transmitting and/or receiving continuously data using the first operational bandwidth 51 when the first conductive element 21 is in the first configuration 41 and using the second operational bandwidth 51 when the first conductive element 21 is in the second configuration 42.

The circuitry 80 can be controlled to operate in one of many specific operational modes depending on the requirement of the user.

In order to protect the circuitry 80 from deformation, it may be supported by the second portion 12 of the substrate 2 or the circuitry 80 may be supported by a separate substrate or printed wiring board, other than substrate 2. This portion 12 of the substrate 2 may be rigid.

As used in this application, the term 'circuitry' refers to all of the following:

(a) hardware-only circuit implementations (such as implementations in only analog and/or digital circuitry) and (b) to combinations of circuits and software (and/or firmware), such as (as applicable):

(i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present and (d) Radio frequency (RF) circuitry, including and not limited to, lumped components providing at least one of resistance, inductance and capacitance, distributed components providing at least one of resistance, inductance and capacitance, integrated circuits, semi-conductors, microwave waveguides, transmission lines, quasi-TEM (Transverse Electro Magnetic) structures e.g. microstrip, filters, amplifiers, mixers, oscillators, matching networks, phase shifters, and so on.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Where a structural feature has been described, it may be replaced by means for performing one or more of the functions of the structural feature whether that function or those functions are explicitly or implicitly described.

It will be appreciated that the foregoing examples describe: an apparatus 10 comprising: antenna means 20 comprising a first radiator means (e.g. first conductive element 21) and second radiator means (e.g. second conductive element 22); and deformable support means (e.g. substrate 2) for supporting at least a portion of the first radiator means (e.g. first conductive element 21); wherein deformation of the support means (e.g. support 2) adds or removes at least one operational resonant bandwidth of the antenna means 20.

The radio frequency circuitry 80 and the antenna 20 may be configured to operate in a plurality of operational resonant bandwidths. For example, the operational frequency bandwidths may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting—handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency bandwidth over which an antenna can efficiently operate is a frequency range where the antenna's return loss is less than an operational threshold. For example, efficient operation may occur when the antenna's return loss is better than (that is, less than) −3 or −4 dB.

As used here 'module' refers to a unit or apparatus that excludes certain parts/components that would be added by an end manufacturer or a user. The apparatus 10 may, in some bit not necessarily all examples, be a module.

Although in the preceding examples a single antenna 20 has been described, it should be appreciated that the apparatus 10 may comprise a plurality of antennas each of which comprises: a first conductive element having a first electrical length and connected to a first antenna terminal; and a second conductive element having a second electrical length connected to a second antenna terminal, wherein at least the first conductive element is supported by a portion of the substrate and wherein at least the first portion of the substrate is configured to deform from a first configuration to a second configuration to:

change the first electrical length of the first conductive element relative to the second electrical length of the second conductive element; and add or remove at least one operational resonant mode of the antenna.

In some but not necessarily all examples, some or all of the plurality of antennas may share a common substrate.

In some but not necessarily all examples, some or all of the first conductive elements of the plurality of antennas may share a common substrate portion. In some but not necessarily all examples, some or all of the first conductive elements of the plurality of antennas may use different substrate portions being physically separated and/or orientated and/or having different rigidity.

In some but not necessarily all examples, some or all of the second conductive elements of the plurality of antennas may share a common substrate portion. In some but not necessarily all examples, some or all of the second conductive elements of the plurality of antennas may use different substrate portions being physically separated and/or orientated and/or having different rigidity.

The plurality of antennas 20 may be arranged as an array for specific functionality.

Although in the preceding examples the first conductive portion and the second conductive portion are aligned along a common axis, in other examples they may be aligned along different axes, for example, orthogonal axes.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one." or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a substrate;

an antenna comprising:

a first conductive element having a first electrical length and connected to a first antenna terminal; and a second conductive element having a second electrical length connected to a second antenna terminal, wherein at least the first conductive element is supported by a first portion of the substrate and wherein at least the first portion of the substrate is configured to deform from a first configuration to a second configuration to:

change the first electrical length of the first conductive element relative to the second electrical length of the second conductive element; and add or remove at least one operational resonant mode of the antenna.

2. An apparatus as claimed in claim 1, wherein one of the first configuration and the second configuration provides a symmetric antenna where the first and second electrical lengths are equal and the other of the first configuration and the second configuration provides an asymmetric antenna where the first and second electrical lengths are unequal.

3. An apparatus as claimed in claim 1, wherein the first configuration provides a symmetric antenna where the first and second electrical lengths are equal and the second configuration provides an asymmetric antenna where the first and second electrical lengths are unequal.

4. An apparatus as claimed in claim 1, wherein the substrate is configured for asymmetric deformation changing at least one of the first electrical length and the second electrical length.

5. An apparatus as claimed in claim 1, wherein at least the first portion of the first substrate is configured to deform from the first configuration to the second configuration to:
add multiple operational resonant modes of the antenna.

6. An apparatus as claimed in claim 1, wherein at least the first portion of the first substrate is configured to deform from the first configuration to the second configuration to:
convert each single operational resonant modes to two resonant modes.

7. An apparatus as claimed in claim 1, wherein at least the first portion of the first substrate is configured to deform from the first configuration to the second configuration to:
redistribute absorbed/radiated energy over different bandwidths, some of which are operational.

8. An apparatus as claimed in claim 1, wherein at least the first portion of the first substrate is configured to deform from the first configuration to the second configuration to:
split absorbed/radiated energy across more distinct operational bandwidths.

9. An apparatus as claimed in claim 1, wherein at least the first portion of the first substrate is configured to deform from the first configuration to the second configuration to:
add at least one new and distinct operational bandwidth where a return loss S11 of the antenna is greater than an operational threshold.

10. An apparatus as claimed in claim 1, wherein at least the first portion of the first substrate is configured to deform from the first configuration to the second configuration to:
change a non-operational bandwidth where a return loss S11 of the antenna is less than an operational threshold to an operational bandwidth where a return loss S11 of the antenna is greater than the operational threshold.

11. An apparatus as claimed in claim 1, wherein at least the first portion of the first substrate is configured to deform from the first configuration to the second configuration to:
introduce more minima for return loss S11 of the antenna.

12. An apparatus as claimed in claim 1, wherein at least the first portion of the first substrate is configured to deform from the first configuration to the second configuration to:
introduce more minima for input impedance Z11 of the antenna.

13. An apparatus as claimed in claim 1, wherein the first conductive element comprises graphene based material.

14. An apparatus as claimed in claim 1, wherein the second conductive element comprises graphene based material.

15. An apparatus as claimed in claim 1, wherein the graphene based material comprises graphene, a graphene derivative, chemical vapor deposited graphene or metal nanoparticle doped graphene.

16. An apparatus as claimed in claim 1, wherein the first conductive element and the second conductive element are formed from the same surface area of conductive material.

17. An apparatus as claimed in claim 1, wherein the first conductive element and the second conductive element have the same cross-sectional area of conductive material.

18. An apparatus as claimed in claim 1, wherein the first conductive element is configured to be strained in use while the second conductive element remains unstrained.

19. An apparatus as claimed in claim 1, wherein the second conductive element supported on a second portion of the substrate, different to the first portion, wherein a Young's Modulus of the second portion is greater than a Young' s Modulus of the first portion.

20. A mobile phone comprising:
a substrate;
an antenna comprising:
a first conductive element having a first electrical length and connected to a first antenna terminal,
a second conductive element having a second electrical length connected to a second antenna terminal,
wherein at least the first conductive element is supported by a first portion of the substrate and wherein at least the first portion of the substrate is configured to deform from a first configuration to a second configuration to:
change the first electrical length of the first conductive element relative to the second electrical length of the second conductive element; and
add or remove at least one operational resonant mode of the antenna; and
circuitry configured to transmit using the antenna when the first conductive element is the first configuration and when the first conductive element is in the second configuration.

* * * * *